US007119641B2

(12) United States Patent
Petrov et al.

(10) Patent No.: US 7,119,641 B2
(45) Date of Patent: Oct. 10, 2006

(54) TUNEABLE DIELECTRIC RESONATOR

(75) Inventors: Peter Petrov, London (GB); Neil McNeill Alford, London (GB)

(73) Assignee: Southbank University Enterprises, LTD, London (GB)

( * ) Notice: Subject to any disclaimer, the term of this patent is extended or adjusted under 35 U.S.C. 154(b) by 0 days.

(21) Appl. No.: 10/474,762

(22) PCT Filed: Apr. 10, 2002

(86) PCT No.: PCT/GB02/01712

§ 371 (c)(1),
(2), (4) Date: Feb. 25, 2004

(87) PCT Pub. No.: WO03/088411

PCT Pub. Date: Oct. 23, 2003

(65) Prior Publication Data

US 2004/0135655 A1 Jul. 15, 2004

(51) Int. Cl.
*H01P 7/10* (2006.01)

(52) U.S. Cl. ..... 333/235; 333/219.1

(58) Field of Classification Search ..... 333/202, 333/219.1, 235

See application file for complete search history.

(56) References Cited

U.S. PATENT DOCUMENTS 4,692,727 A * 9/1987 Wakino et al. ..... 333/219.1
5,049,842 A * 9/1991 Ishikawa et al. ..... 333/235
5,324,713 A * 6/1994 Shen ..... 505/210
5,721,194 A 2/1998 Yandrofski et al.
5,935,910 A 8/1999 Das
5,990,766 A 11/1999 Zhang et al.
6,049,726 A 4/2000 Gruenwald et al.
6,097,263 A * 8/2000 Mueller et al. ..... 333/17.1
6,463,308 B1 * 10/2002 Wikborg et al. ..... 333/202
6,737,179 B1 * 5/2004 Sengupta ..... 428/702

FOREIGN PATENT DOCUMENTS

WO WO94/28592 12/1994

OTHER PUBLICATIONS

Vendik et al., "Ferroelectric Tuning of Planar and Bulk Microwave Devices," Journal of Superconductivity, vol. 12, No. 2, Apr. 1999, pp. 325-338.

Velichko et al., "On a Developmnt Possibility of a Tunable Mirowave Passband Filter Based on Dielectric Resonator With High Tc Film", International Journal of Infrared and Millimeter Waves, No. 10, Oct. 1994, pp. 1631-1642.

* cited by examiner

*Primary Examiner*—Seungsook Ham
(74) *Attorney, Agent, or Firm*—Anthony R. Barkume, P.C.

(57) ABSTRACT

A method of tuning a dielectric resonator uses a ferroelectric element to change the dielectric resonator electric field and hence the resonance frequency of the dielectric resonator.

9 Claims, 6 Drawing Sheets

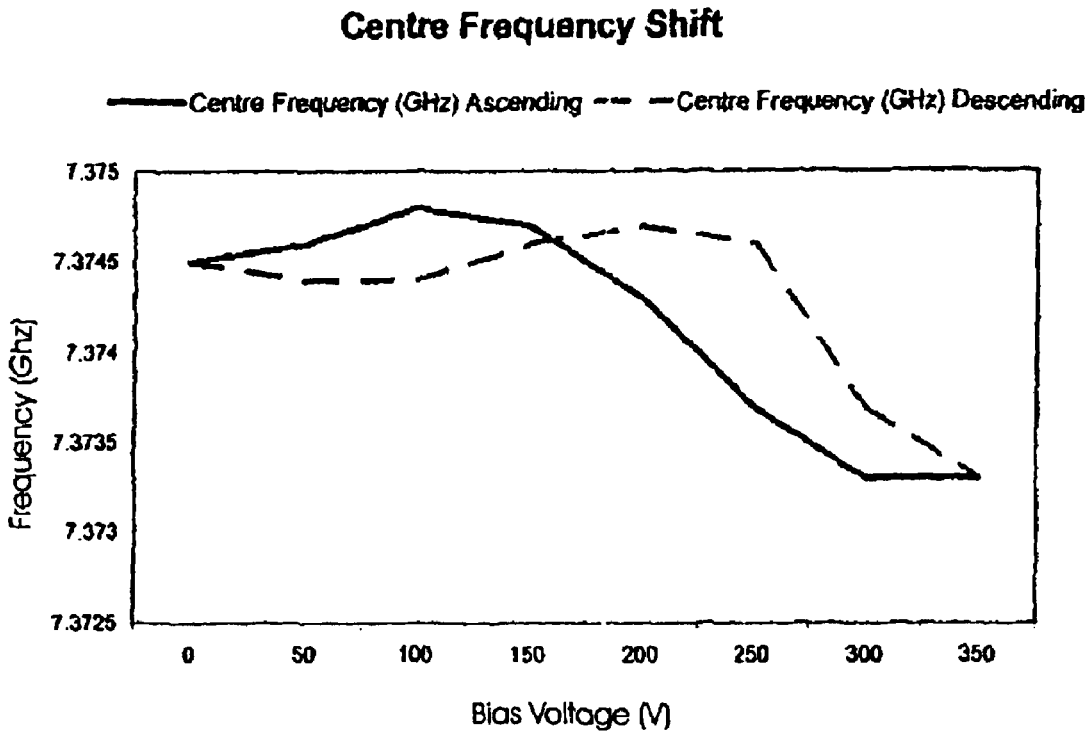
Fig. 4 Measurement results (Example 2)

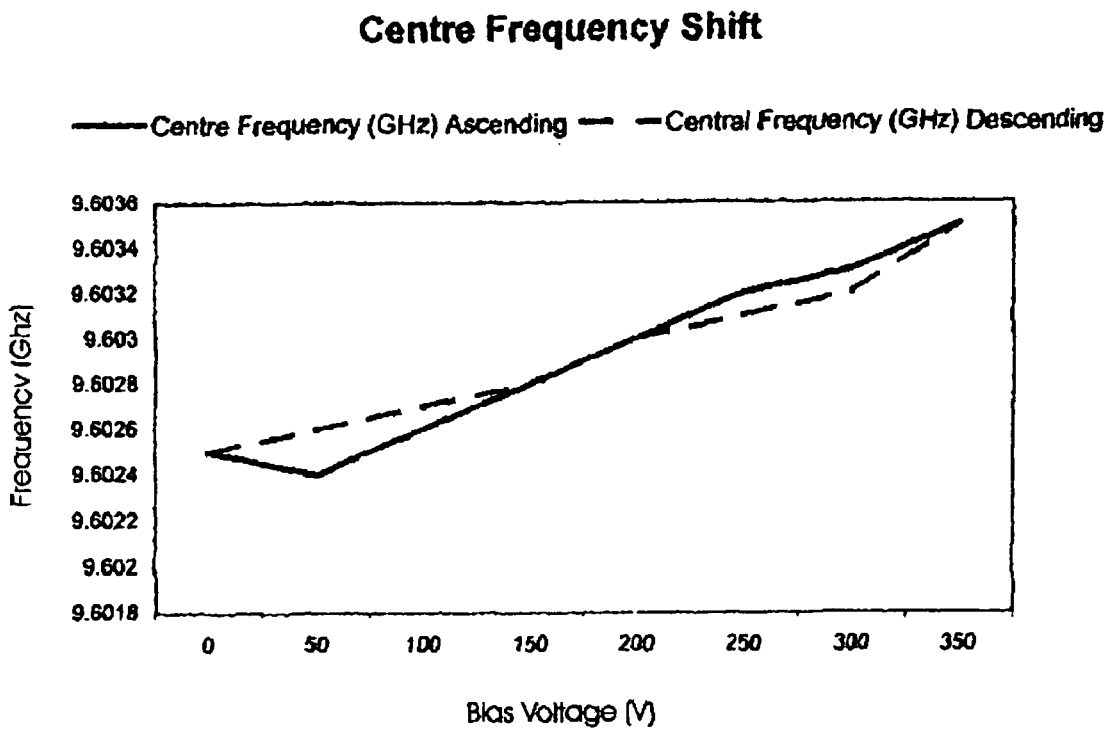
Fig. 5 Measurement results (Example 3)

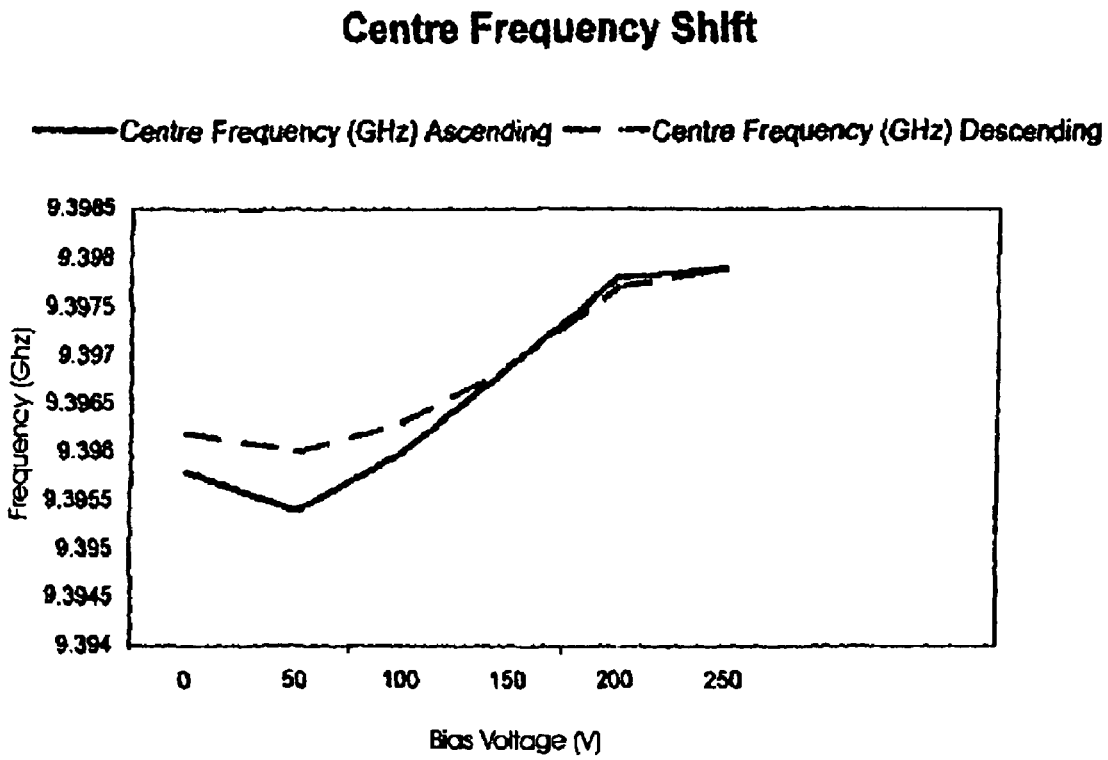
Fig. 6 Measurement results (Example 4)

TUNEABLE DIELECTRIC RESONATOR

This invention relates to dielectric resonators.

Dielectric resonators (DRs) are key elements for filters, low phase noise oscillators and frequency standards in current microwave communication technology. DRs possess resonator quality factors (Q) comparable to cavity resonators, strong linearity at high power levels, weak temperature coefficients, high mechanical stability and small size.

Ceramic dielectric materials are used to form thermally stable DRs as key components in a number of microwave subsystems which are used in a range of consumer and commercial market products. These products range from Satellite TV receiver modules (frequency converter for Low Noise Broadcast (LNB), Cellular Telephones, PCN's. (Personal Communication Networks Systems) and VSAT (Very Small Aperture Satellite) systems for commercial application to emerging uses in transportation and automobile projects, such as sensors in traffic management schemes and vehicle anti-collision devices. Dielectric Resonators may be used to determine and stabilise the frequency of a microwave oscillator or as a resonant element in a microwave filter. New systems of satellite TV transmission based on digital encoding and compression of the video signals determine, the need for improved DR components. The availability of advanced materials will also enable necessary advances in the performance of DRs used for these and other purposes.

In DRs in the areas of communications over a wide frequency range, low dielectric loss materials are highly desirable, for example in the base stations required for mobile communications. Dielectric resonators using dielectric sintered ceramics are commonly used and the dielectric materials used are often complex mixtures of elements. One of the earliest resonator materials was Barium Titanate ($BaTiO_3$ or $BaTi_4O_9$ see for example T. Negas et al American Ceramic Society Bulletin vol 72 pp 90–89 1993).

The dielectric loss of a material is referred to as the tan delta and the inverse of this quantity is called the Q (Quality Factor). The Q factor of a resonator is determined by choosing a resonance and then dividing the resonant frequency by the bandwidth 3 dB below the peak.

In microwave communication technology dielectric resonators are well known and widely used circuit elements for filters, low phase noise oscillators and frequency standards. By altering the electric field of the dielectric resonators (which in turn affects the magnetic field) is it possible to change tune their resonant frequency. Usually a dielectric resonator is tuned by a tuning screw, made from either metal or dielectric material, from above, below or through the dielectric element (when ring shape dielectric resonators is used). The speed of tuning is limited by the time of tuning screw movement.

In view of these considerations, a need exists for fast tuning of dielectric resonators without reducing of the Q factor.

For fast resonance frequency changing an electrical tuning element is included in the control (input/output) circuit. As electrical tuning elements pin-diodes or ferroelectric based devices are used. Having a Q factor few orders of magnitude less than the one of dielectric resonators, electrical tuning elements reduce the quality factor of the whole circuit. Therefore their use in communication equipment is limited.

Attempts to improve the tuning ability of dielectric resonators are disclosed in U.S. Pat. Nos. 4,728,913, 5,049,842, 4,630,012, 4,385,279, and 4,521,746, but the currently used methods suffer from disadvantages.

We have devised an improved method of tuning dielectric resonators which overcomes these difficulties.

According to the invention there is provided a method of tuning a dielectric resonator which method comprises changing the frequency of the resonator by a frequency changing means which is operated using a ferroelectric element In the method of the invention the ferroelectric element changes the electric field of the resonator which changes the frequency of the resonator.

The invention also provides a tuneable dielectric resonator comprising a cavity within which is mounted a dielectric and a frequency changing means, which frequency changing means is operated using a ferroelectric element.

Preferably the ferroelectric element is a ferroelectric film which is formed on a substrate or on the resonator cavity bottom, the resonator upper plate, or on one or more of the resonator surrounding cavity walls. Alternatively the ferroelectric element can surround the dielectric resonator.

In one embodiment the ferroelectric element comprises a conductive substrate on which there is a ferroelectric film to which film is connected an upper conductive electrode. On applying a dc bias, the relative permittivity of the ferroelectric film decreases and hence affects the dielectric resonator electric field and changes the resonance frequency of the dielectric resonator.

The conductive substrate is preferably formed of a metal such as silver, or a high melting point metal such as Pt, Pd, high temperature alloy, etc.

Any ferroelectric material can be used and preferred materials are $Ba_xSr_{1-x}TiO_3$ (BSTO) films. Th films can be deposited on the substrate by conventional methods such as forming a film paste of ferroelectric material on the substrate and heating the paste, magnetron sputtering, PLD, sol-gel, MOCVD, e-beam/thermal evaporation, etc.

The upper conductive electrode can be made of a high conductivity metal such as, but not restricted to, silver or gold and electrically connected to the ferroelectric element.

In a device of the invention preferably the ferroelectric element is spaced apart from the dielectric resonator by a spacer formed of a low loss dielectric material, for example, but not limited to, quartz, $Al_2O_3$, polystyrene etc., Because of the gap between the ferroelectric element and the dielectric resonator due to the spacer, the coupling between the dielectric resonator and the ferroelectric film is weak and reduction of the Q-factor is not significant.

In a preferred embodiment of the invention the ferroelectric element is formed as a film on the conductive base which is supported on the floor of the resonator. The dielectric element and spacer are ring shaped and the spacer is positioned on the ferroelectric element and the dielectric element is placed on the spacer, the wire electrode then passes through the spacer and the dielectric element and is connected to the ferroelectric element. A dc bias can then be passed through the ferroelectric element between the conductive substrate and the electrode to decrease the relative permittivity of the ferroelectric film and hence change the dielectric resonator electric field.

The invention provides a sensitive rapid means of tuning a dielectric resonator.

BRIEF DESCRIPTION OF THE DRAWINGS

FIG. 4 illustrates a graph of the results of Example 2.

FIG. 5 illustrates a graph of the results of Example 3.

FIG. 6 illustrates a graph of the results of Example 4.

Referring to FIG. 1 a resonator cavity (1) has a conductive substrate base (2) on the surface of which is formed a ferroelectric film (6) which is the ferroelectric element. There is a ring shaped spacer (3) on which is supported the ring shaped dielectric (4). Wire (5) passes through the ring shaped dielectric (4) and spacer (3) and is soldered to ferroelectric fin (6) through a silver electrode.

Figure 1:
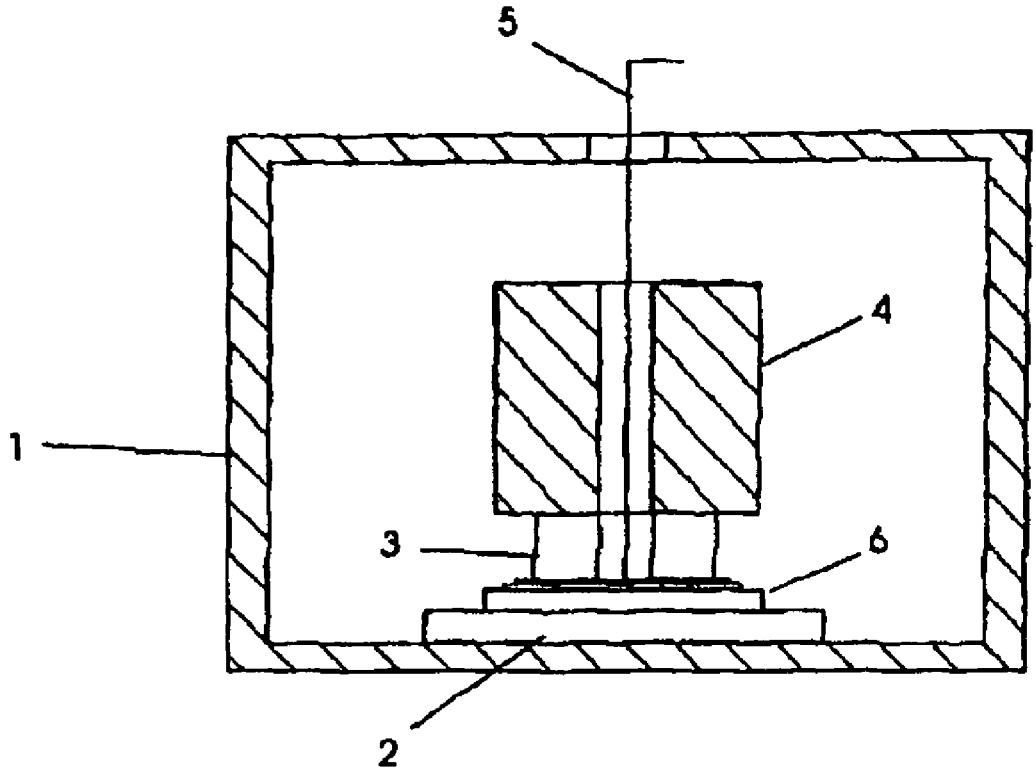
FIG. 1 illustrates a resonator according to the present invention.
Figure 2:
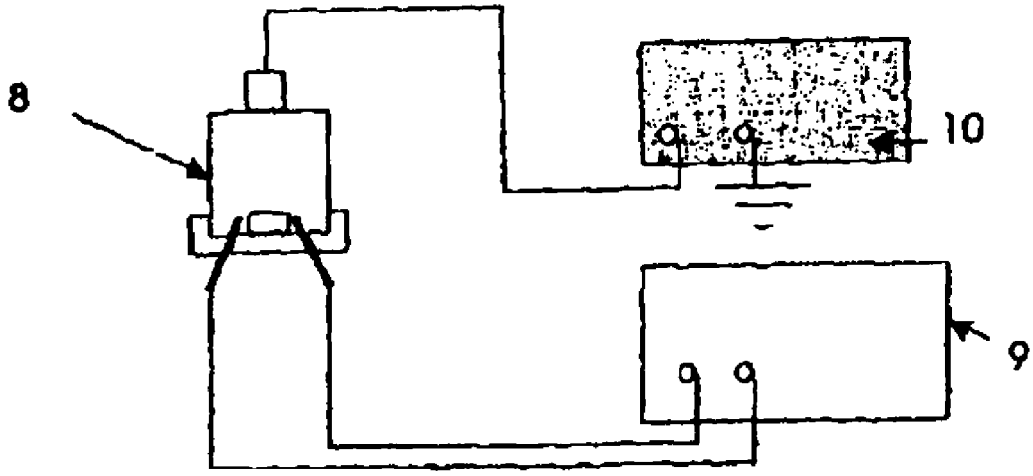
FIG. 2 illustrates a tuning circuit according to the present invention.

In use a circuit was set up as in FIG. 2 with the resonator (8) part of a circuit with network analyser (9). The power was applied across the ferroelectric film (6) through the wire (5) and the conductive substrate (2). By applying a the voltage from power supply (10), the dc bias across the ferroelectric film (6) is increased which decreases the relative permittivity of the ferroelectric film and hence changes the dielectric resonator electric field. In conjunction with the network analyser (9) the resonator can then be tuned by varying the dc bias.

The invention is described in the Examples in which Ag disks (20 mm in diameter, 1 mm thick) were used as conductive substrates for growing of $Ba_xSr_{1-x}TiO_3$ (BSTO) films. In the examples below, the BSTO thick film possessed a significant degree of porosity (50–60%) and this reduced the effective $\epsilon_P$ and hence the tuning capability is reduced. It is thought that reducing porosity would improve performance.

EXAMPLE 1

A thick film paste of BSTO was prepared with BSTO powder (Ba/Sr ratio 75%/25%). The powder was thoroughly mixed with a vehicle comprising non-aqueous polymers and solvents. The thick film paste was applied on to the surface of the silver disc. The paste was dried at 80° C. and then the composite was fired at 900° C. for 6 hours. The thickness of the BSTO fin was between 80–120 μm.

An upper Ag electrode was prepared by applying a silver paste.

A 0.2 mm in diameter wire was soldered onto the centre of the upper electrode.

A ring shaped quartz spacer is placed on the upper electrode and the ring shape dielectric resonator (unloaded Q=3,400 at 7.3 GHz) is placed upon the quartz spacer. The wire which has been attached to the upper electrode passed through the central hole of both quartz spacer and dielectric resonator.

The measurement setup was assembled as presented on FIG. 2. Using a high voltage power supply a dc bias was applied on the BSTO film resulting in electric field of 3.5 kV/cm. The $TE_{011}$ node was shifted by 2 MHz.

The results are shown in Table 1.

TABLE 1

| Bias Voltage (V) | Centre Frequency (GHz) (Ascending) | Centre Frequency (GHz) (Descending) | Quality Factor (Q) |
|---|---|---|---|
| 0 | 7.6541 | 7.6537 | 1138 |
| 50 | 7.6542 | 7.6538 | 1142 |
| 100 | 7.6546 | 7.6541 | 1143 |
| 150 | 7.6551 | 7.6546 | 1111 |
| 200 | 7.6555 | 7.6552 | 1043 |

TABLE 1-continued

| Bias Voltage (V) | Centre Frequency (GHz) (Ascending) | Centre Frequency (GHz) (Descending) | Quality Factor (Q) |
|---|---|---|---|
| 250 | 7.6558 | 7.6556 | 1028 |
| 300 | 7.6559 | 7.6558 | 1011 |
| 350 | 7.6561 | 7.6561 | 1005 |

Figure 3:
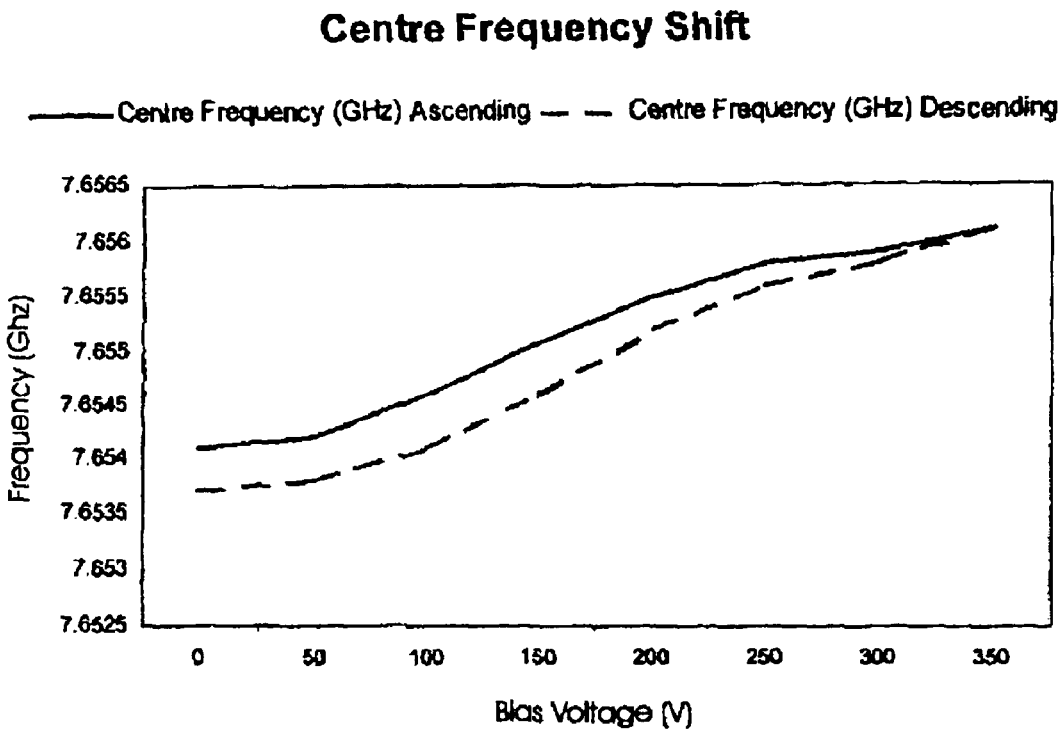
FIG. 3 illustrates a graph of the results of Example 1.

Graphs showing the results are shown in FIG. 3

EXAMPLE 2

The procedure in example 1 was repeated except that the ferroelectric film of different composition ($B_{B_{0.50}}Sr_{0.50}TiO_3$) was used which resulted in shifting of the $TE_{011}$ mode by 1.2 MHz. The results are shown in Table 2

TABLE 2

| Bias Voltage (V) | Centre Frequency (GHz) (Ascending) | Centre Frequency (GHz) (Descending) | Quality Factor (Q) |
|---|---|---|---|
| | 7.3745 | 7.3745 | 1770 |
| 50 | 7.3744 | 7.3745 | 1800 |
| 100 | 7.3745 | 7.3745 | 1780 |
| 150 | 7.3746 | 7.3746 | 1660 |
| 200 | 7.3748 | 7.3747 | 1420 |
| 250 | 7.3746 | 7.3748 | 1170 |
| 300 | 7.3737 | 7.3741 | 1150 |
| 350 | 7.3733 | 7.3733 | 1350 |

Graphs showing the results are shown in FIG. 4

EXAMPLE 3

The procedure in example 1 was repeated except that the DR of $Al_2O_3$ (Q=1,800) at 9.4 GHz) was used which rest in shifting of the $TE_{011}$ mode by 1 MHz.

The results are shown in Table 3.

TABLE 3

| Bias Voltage (V) | Centre Frequency (GHz) (Ascending) | Centre Frequency (GHz) (Descending) | Quality Factor (Q) |
|---|---|---|---|
| 0 | 9.6025 | 9.6025 | 938 |
| 50 | 9.6024 | 9.6026 | 938 |
| 100 | 9.6026 | 9.6027 | 942 |
| 150 | 9.6028 | 9.6028 | 912 |
| 200 | 9.6030 | 9.6030 | 889 |
| 250 | 9.6032 | 9.6031 | 842 |
| 300 | 9.6033 | 9.6032 | 800 |
| 350 | 9.6035 | 9.6035 | 755 |

Graphs showing the results are shown in FIG. 5

EXAMPLE 4

The procedure in example 3 was repeated except that the ferroelectric film was grown on the bottom cavity plate which resulted in shifting of the $TE_{011}$ mode by 2.1 MHz.

The results are shown in Table 4.

TABLE 4

| Bias Voltage (V) | Centre Frequency (GHz) (Ascending) | Centre Frequency (GHz) (Descending) | Quality Factor (Q) |
|---|---|---|---|
| 0 | 9.3958 | 9.3962 | 563 |
| 50 | 9.3954 | 9.3960 | 548 |
| 100 | 9.3960 | 9.3963 | 565 |
| 150 | 9.3969 | 9.3989 | 552 |
| 200 | 9.3978 | 9.3977 | 504 |
| 250 | 9.3979 | 9.3979 | 470 |

Graphs showing the results are shown in FIG. 6

The invention claimed is:

1. A method of tuning a dielectric resonator which resonator comprises a cavity within which is mounted a dielectric which method comprises changing the frequency of the resonator by a frequency changing means which is operated using a ferroelectric element in which a DC bias is applied across the ferroelectric element to decrease the relative permittivity of the ferroelectric element which affects the dielectric resonator electric field and changes the resonance frequency of the resonator, in which the ferroelectric element is a ferroelectric film, in which the ferroelectric film is mounted on a conductive base on which is positioned a spacer and the dielectric is mounted on the spacer, in which the conductive base, on which is formed the ferroelectric element, is supported on a floor of the resonator, the dielectric element and spacer are ring shaped, the spacer is positioned on the ferroelectric element and the dielectric element is placed on the spacer, and in which there is a wire electrode which passes through the spacer and the dielectric element and is connected to the ferroelectric element, there being a means to apply a DC bias to the ferroelectric element through the conductive base and the wire.

2. A method as claimed in claim 1 in which the spacer is made of a low loss low dielectric constant spacer.

3. A method as claimed in claim 1 in which the ferroelectric element is ferroelectric film grown on a conductive substrate.

4. A method as claimed in claim 1 in which the ferroelectric element is ferroelectric film grown on a resonator cavity bottom, a resonator upper plate, or on one or more of resonator surrounding cavity walls.

5. A tuneable dielectric resonator which comprises a cavity within which is mounted a dielectric and a frequency changing means and in which the frequency changing means is operated using a ferroelectric element, in which a DC bias is applied across the ferroelectric element to decrease the relative permittivity of the ferroelectric element which affects the dielectric resonator electric field and changes the resonance frequency of the resonator, in which the ferroelectric element is a ferroelectric film, in which the ferroelectric film is mounted on a conductive base on which is positioned a spacer and the dielectric is mounted on the spacer, in which the conductive base, on which is formed the ferroelectric element, is supported on a floor of the resonator, the dielectric element and spacer are ring shaped, the spacer is positioned on the ferroelectric element and the dielectric element is placed on the spacer, and in which there is a wire electrode which passes through the spacer and the dielectric element and is connected to the ferroelectric element, there being a means to apply a DC bias to the ferroelectric element through the conductive base and the wire.

6. A tuneable dielectric resonator as claimed in claim 5 in which the spacer is made of a low loss low dielectric constant.

7. A tuneable dielectric resonator as claimed in claim 5 in which the ferroelectric element is mounted on the resonator cavity bottom or resonator upper plate, or surrounding resonator cavity walls.

8. A tuneable dielectric resonator as claimed in claim 5 in which the frequency changing means comprises a ferroelectric element on which is mounted a dielectric resonator.

9. A tuneable dielectric resonator as claimed in claim 5 in which the ferroelectric material is $Ba_xSr_{1-x}TiO_3$.

* * * * *